US005685178A

United States Patent [19]

Ahn

[11] Patent Number: 5,685,178

[45] Date of Patent: Nov. 11, 1997

[54] DETERGENT DISSOLUTION APPARATUS HAVING A ROTARY WATER JET

[75] Inventor: Ki Pyo Ahn, Songtan, Rep. of Korea

[73] Assignee: Samsung Electronics Co., Ltd., Suwon, Rep. of Korea

[21] Appl. No.: 460,146

[22] Filed: Jun. 2, 1995

[30] Foreign Application Priority Data

Nov. 11, 1994 [KP] DPR of Korea ..... 1994-29643

[51] Int. Cl.[6] ..... D06F 39/08

[52] U.S. Cl. ..... 68/17 R; 68/207; 68/183; 134/93; 137/268

[58] Field of Search ..... 134/93, 201; 68/17; 137/268; 222/67, 372, 395; 608/207, 183

[56] References Cited

U.S. PATENT DOCUMENTS

| | | | |
|---|---|---|---|
| 2,542,431 | 1/1951 | Rice | 137/268 |
| 2,546,317 | 3/1951 | Prizer | 137/268 |
| 2,857,202 | 10/1958 | Snyder | 137/268 |
| 3,199,957 | 8/1965 | Vivion | 137/268 |
| 3,303,675 | 2/1967 | Severance et al. | 134/93 |
| 4,154,258 | 5/1979 | Duda et al. | 137/268 |
| 4,462,967 | 7/1984 | Berelson | 134/93 |
| 4,671,311 | 6/1987 | Hepperle et al. | 137/268 |

*Primary Examiner*—Frankie L. Stinson

*Attorney, Agent, or Firm*—Burns, Doane, Swecker & Mathis, L.L.P.

[57] ABSTRACT

A detergent dissolving device for a clothes washing machine includes a receptacle for powdered detergent, and a cover for covering the top of the receptacle. The cover has a water supply opening. A water jet is provided for discharging a jet of water through the water supply opening along a direction inclined with respect to vertical and horizontal. The water jet is freely rotatable about a vertical axis and includes blades arranged to contact a water flow entering the water jet, whereby the water jet is rotated by the force of the water flow.

11 Claims, 3 Drawing Sheets

DETERGENT DISSOLUTION APPARATUS HAVING A ROTARY WATER JET

BACKGROUND OF THE INVENTION

This invention relates to a detergent dissolution apparatus of having a rotation jetting member, and more particularly to a detergent dissolution apparatus having a rotation jetting member that is rotated by the nozzle stream which is applied evenly on the laundry detergent.

In general, when laundry is washed by a washing machine, some remnants of the detergent employed to wash the laundry frequently remains, unless the rising cycle is performed several times, or the detergent is dissolved with water in advance on the outside of the washing machine and the dissolved detergent being poured into the tub of the washing machine. Therefore, the solution of the problem may involve a mechanical detergent dissolving apparatus which can prevent the detergent from remaining on clothes.

A conventional mechanical detergent dissolving apparatus which utilizes a stream force jetted through a water supply nozzle is illustrated in FIG. 5. The mechanical detergent dissolving apparatus comprises a lower detergent receptacle 120 having the detergent therein, and an upper cover 140 attached by a hinge to the receptacle 120 and furthermore, includes a filter 141 over the receptacle 120. The lower detergent receptacle 120 is shaped as a hemisphere, and comprises a convex member 127 formed at the bottom center area, and a plurality of guiders 125 on the inner wall of the convex member 127. The upper cover 140 is shaped as the dome, and comprises a filter 141 having a water supply opening 143. As the dissolution apparatus is fully inserted into the compartment 180, the water supply opening 143 of the upper cover 140 is disposed directly under the water supply member 160. Through the water supply opening 143 the water stream jetted from the warm and cool water nozzles 161,163 of the water supply member 160 converge and are jetted into the containing member 120.

In the detergent dissolving apparatus, in order to dissolve the detergent evenly, the washing water passing through the water supply member 160 must be jetted into the upper part of the convex member 127 and then guided along the slope of the convex member 127. Namely, since the jet pressure of the warm water nozzle 161 and the jet pressure of the cold water nozzle 163 are not identical to each other, the water jetted converges on the right lower plane 127H of the lower detergent receptacle 120 when the larger jet pressure is that of the warm water nozzle 161, or converges on the left lower plane 127C thereof when the larger jet pressure is that of the cold water nozzle 163. The above situation produces a problem where a lump of detergent forms on a portion of receptacle not directly receiving the jet. The portion is the lower left plane 127C of the lower detergent receptacle 120 when the larger jet pressure is that of the warm water nozzle 161 or the right lower plane 127H when the larger jet pressure is that of the cold water nozzle 163. The problem is further exacerbated if the warm water or the cold water is individually jetted.

SUMMARY OF THE INVENTION

An object of the present invention is to provide a detergent dissolution apparatus having a rotary jetting member that prevents the jetted washing water from being directed onto only one portion of the detergent.

Another object of the present invention is to provide a detergent dissolution apparatus having a rotary jetting member in which the jetted water stream is effectively applied onto the detergent thus dissolving the detergent evenly with the water, and reducing the remaining volume of detergent while increasing the detergent's solubility, thereby preventing environmental pollution caused by the usage of detergents.

According to the present invention, the detergent dissolution apparatus comprises a lower detergent receptacle having detergent; an upper cover encompassing the upper portion of the lower detergent receptacle, and further having a water supply opening; and a rotary jetting member which evenly supplies water passing through the water supply opening onto the detergent.

Further, the rotary jetting member comprises a hollow body; an inlet formed on one end of the body for receiving water through the nozzle; and an outlet formed on the other end of the body for supplying water to the detergent.

In addition, the rotary jetting member comprises a plurality of blades radially formed on the inside walls of the body, and an axis penetrating the center point of the outlet is arranged parallel at a predetermined distance from the rotation axis of the body.

DESCRIPTION OF THE PREFERRED EMBODIMENTS

Figure 1:
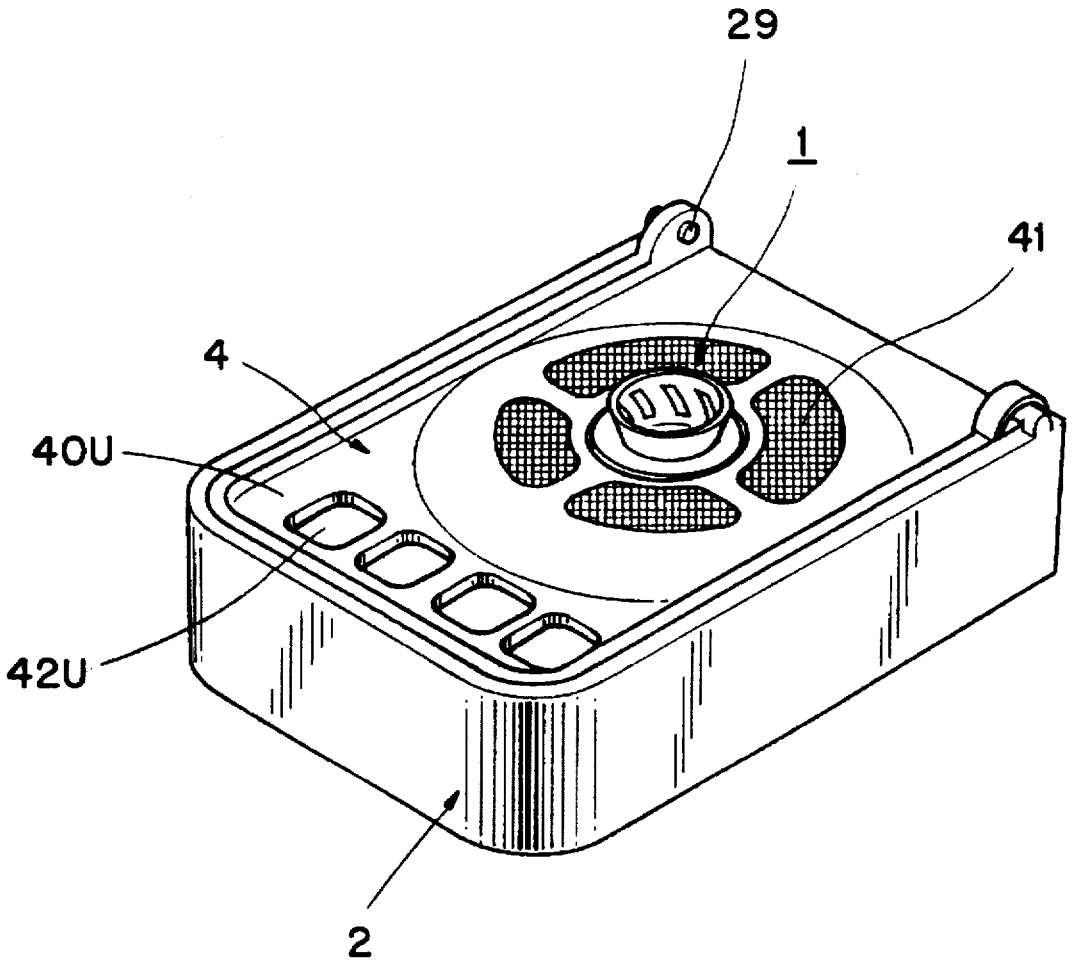
FIG. 1 is a top perspective view of a detergent dissolution apparatus having a rotary jetting member placed on an upper cover according to a first embodiment the invention.
Figure 2:
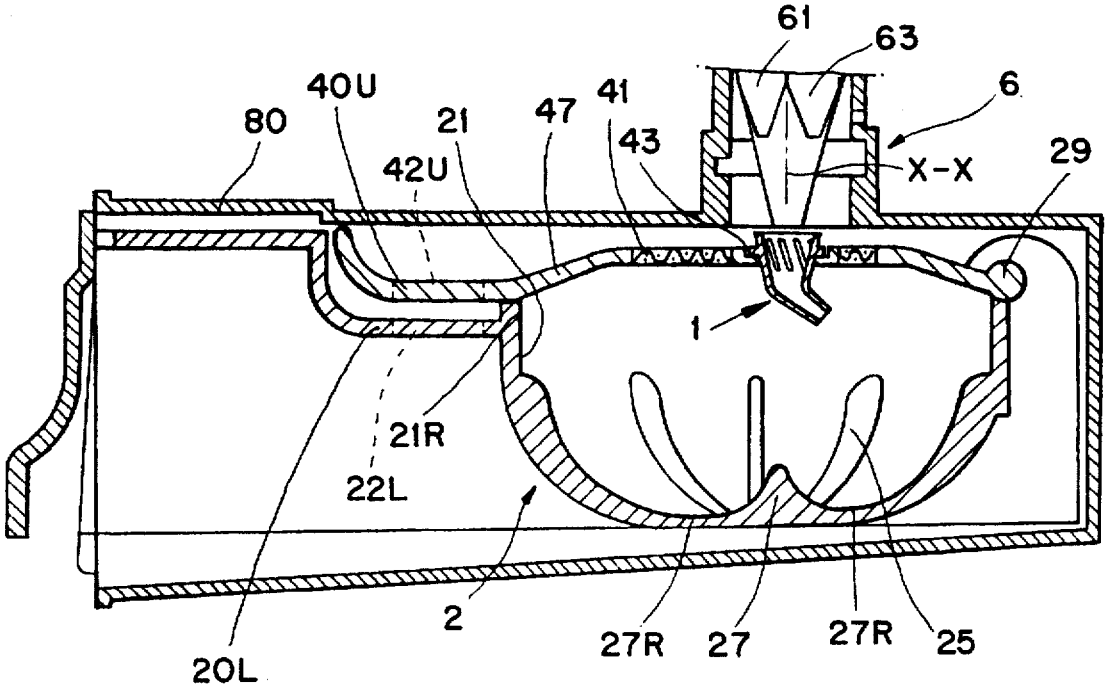
FIG. 2 is a vertical sectional view of the detergent dissolution apparatus having the rotary jetting member of FIG. 1 housed in a compartment.
Figure 3:
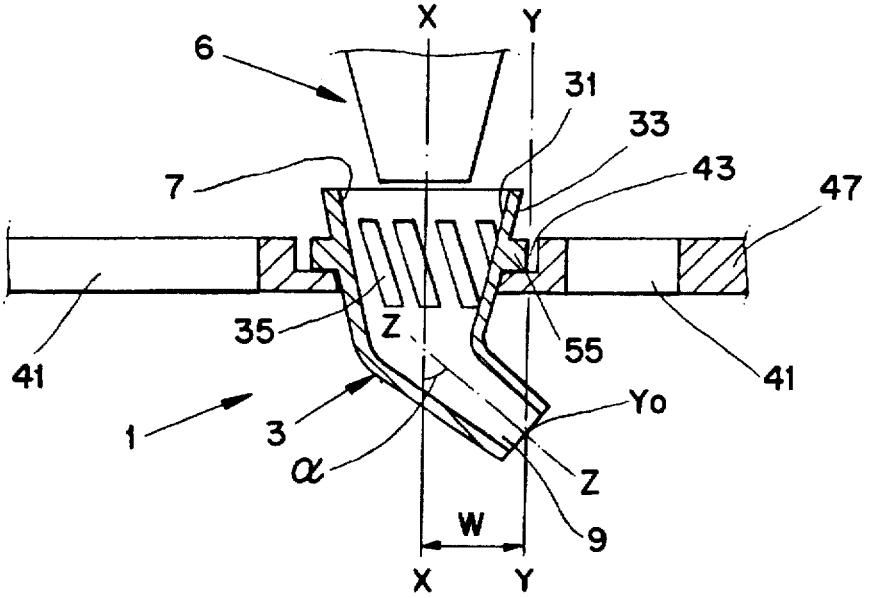
FIG. 3 is an enlarged vertical sectional view of the rotary jetting member of FIG. 2.

In FIGS. 1 to 3, a detergent dissolution apparatus having a rotary jetting member comprises a container formed by a lower detergent receptacle 2 having a detergent containing member 21, and a top wall defined by an upper cover 4 placed over the lower detergent receptacle 2A water supply member 1 is rotatably mounted on the upper cover 4. The upper cover 4 provides a filter 41 in the center portion of the cover 4. The filter has a supply opening 43 for the passage of the water stream through the water supply member 1.

On the outer ring of the filter 41, a domed guide 47 is provided for evenly circulating the water housed in the detergent containing member 21. A space is created between the top portion of detergent in the detergent receptacle 2 and the lower surface of the guide member 47 of the upper cover 4. Further, on the upper cover 4, a plurality of openings 42U are formed on a flange 40U provided as the outer portion of the guide member 47, and the water with detergent dissolved therein (hereinafter "solution") passing through the filter 41 is sent to the tub of the washing machine (not shown) through the below mentioned opening 22L of the detergent receptacle 2.

The detergent receptacle 2 comprises a flange 20L formed around the circumference of the detergent containing member 21. The containing member 21 comprises a convex bottom portion 27 of which the center is co-axially aligned with the center of the water supply opening 43 of the upper cover 4. In addition, a plurality of guide ribs 25 are radially extending between the upper rim 21R of the detergent containing member 21 and the lower rim 27R of the convex portion 27. The convex portion 27 and the guide ribs 25 are formed for guiding the water stream from the rotating jet member 1 to properly circulate the detergent in the containing member 21. Furthermore, a plurality of openings 22L are provided in the flange 20L and are aligned with the openings 42U of the upper cover 4. The solution then flows through the openings 20U, 20L to the tub (not shown). At both ends of the rear portion of the respective detergent receptacle 2 and that of the upper cover 4, a hinge portion 29 controlled by a coil spring (not shown) is provided. The hinge portion 29 enables the opening and closing operation of the upper cover 4.

Shown in FIG. 3, the rotating jet member 1 comprises a hollow body 3, an inlet 7 provided in the upper portion of the body 3, and a outlet 9 disposed in the lower portion of the body 3. The washing water is inputted to the inlet 7 from the water supply member 6 and is then outputted through the outlet 9 to the detergent in the containing member 21.

The body 3 is a formed as a truncated cone, rotatable around an axis X—X, and having a lower portion slantingly curved downward. The body 3 is arranged so that the axis X—X is extending between the warm water nozzle 61 and the cold water nozzle 63 (shown in FIG. 2). Furthermore, a plurality of blades 35 are radially formed on the upper portion of the inner wall 31 of the body 3. These blades 35 are inclined obliquely relative to vertical to be rotated by the jet nozzle washing water. The shape of the blade is not confined to the depicted shape.

The inlet 7 is placed at a predetermined interval from the lower edge of the water supply member 6 as shown in FIG. 3. Further, the outer diameter of the inlet 7 encompasses the foot is lager than the lower edge of the water supply member 6, therefore preventing the water stream jetted by the water supply member 6 from flowing out of the inlet 7.

The outlet 9 is positioned on the lower slant portion of the body 3, and an axis Y—Y placed in parallel with the axis X—X intersects the center point Yo of the outlet thereof. The axis Y—Y is at an interval W from the axis X—X. An oblique angle $\alpha$ is produced by the central axis Z—Z of the outlet 9 and the axis X—X of the inlet 7. The angle $\alpha$ is changed according to the size of the interval W. It is possible that the angle $\alpha$ could be adjusted for the water stream passing through the outlet 9 to reach the lowest portion 27R of the detergent containing member 21.

Meanwhile, a bearing member 55 protrudes outward around the outer wall 33 of the upper portion of the body 3 for smooth rotating operation of the body 3.

The detergent dissolution apparatus having a rotating jet member, and built as described, operates as follows. A predetermined volume of detergent is poured into the containing member 21, and then the receptacle 2 is pushed into the compartment 80. In the wash process using warm water, the water stream from the warm water nozzle 61 is jetted into the rotating jet member 1. Alternatively, in the wash process using cold water, the water stream from the cold water nozzle 63 is jetted into the rotating jet member 1. The cold or warm water stream passes through the inlet 7. The water stream strikes one of the blades 35 causing it to rotate. It follows that the water stream then strikes other blades sequently, and therefore makes the body 3 turn about the axis X—X. On descending, the water stream passes the lower slant portion of the body 3 and it's path is changed by the oblique angle $\alpha$. The water stream comes out of the outlet 9 and reaches the lowest portion 27R of the detergent receptacle 2. Going along the circumferential part of the portion 27R, the stream causes the detergent to dissolve evenly. Also the water stream travels up along the guide ribs 25 radially and dissolves the remaining detergent on the brim of the detergent containing member 21. Rising continuously, the stream travels along the inner surface of the dome-shaped guide member 47 of the upper cover 4 and drops again onto the convex member 27. The recycled dissolved water is mixed with the new-incoming water and the above dissolution process is repeated continuously.

Most of the detergent laid around the convex member 27 is dissolved while at the same time creating bubbles. The bubbled detergent passing through the filter 41 then flows up through the upper cover 4, and the stream drops to the tub of the washing machine through the openings 42U,22L.

Figure 4:
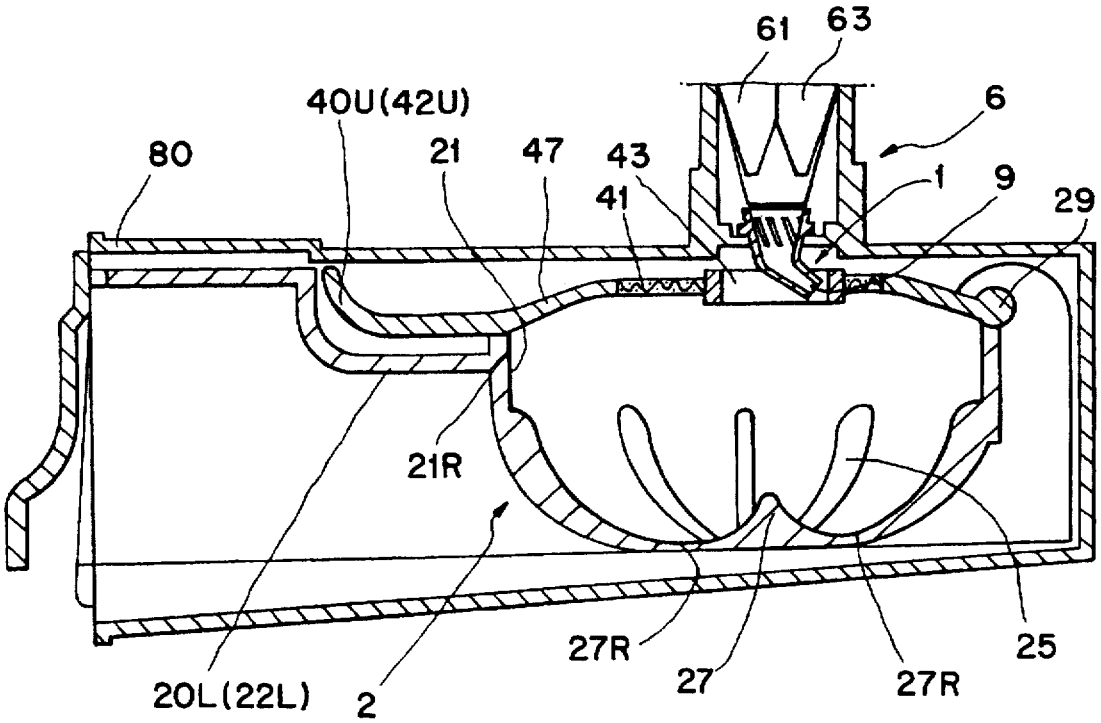
FIG. 4 is a vertical sectional view of another embodiment of a detergent dissolution apparatus having a rotary jetting member housed in a compartment of a washing machine according to the invention.
Figure 5:
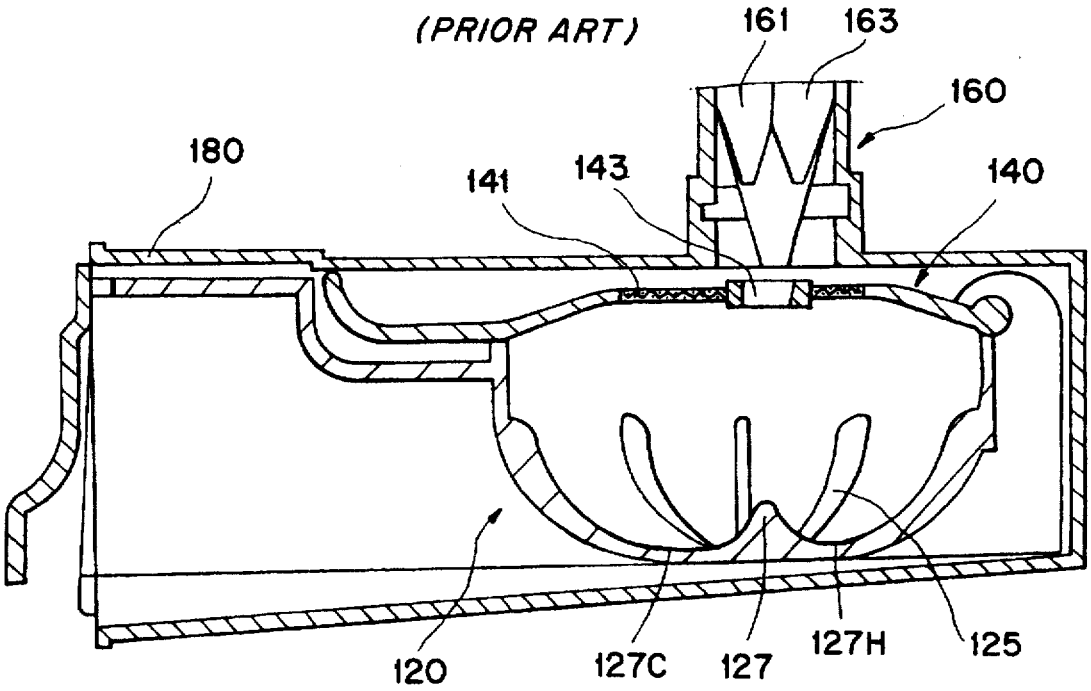
FIG. 5 (PRIOR ART)
FIG. 5 is a vertical sectional view of a detergent dissolution apparatus having a jetting member housed in a compartment according to a prior art.

FIG. 4 shows another embodiment of the detergent dissolution apparatus having a rotating jet member. The rotating jet member 1 is rotatably mounted in the compartment 80 which houses the lower detergent member 2 and the upper cover 4. The rotation jetting member 1 is placed over the upper portion of the upper cover 4.

The rotating jet member 1 is mounted in the upper portion of the compartment 80 above the water supply opening 43 of the upper cover 4. The outlet 9 of the rotating jet member 1 extends downward past the water supply opening 43 of the upper cover 4. This prevents parts of the undissolved detergent from overflowing through the supply opening 43.

According to the structure of the rotating jet member, the wash water which travels through the warm water nozzle or cold water nozzle is evenly supplied over detergent contained in the receptacle, and that prevents the possibility of a chunk of detergent being caused by the concentrated flow of a fixed-direction water jet. Further, this prevents the environmental pollution caused by the excessive usage of detergent.

What is claimed is:

1. A detergent dissolving apparatus for a clothes washing machine, comprising: a container including:

a detergent receptacle having a floor on which powder detergent can be placed, and a top wall overlying the receptacle;

a water supply conduit overlying the top wall and arranged to direct a stream of water downwardly theretowards;

a jetting member mounted in the top wall for rotation about a substantially vertical first axis and arranged to be rotated by the stream of water supplied by the water supply conduit, the jetting member including an upwardly open water inlet for receiving the water stream, and a downwardly directed water outlet for ejecting the water stream, the water outlet defining a second axis extending downwardly at an acute angle relative to the first axis to eject the water stream downwardly into the receptacle as the jetting member rotates about the first axis, so that powder detergent can be mixed with and dissolved in the water and rise along with the water while being contacted by the downward water stream; and a water/detergent outlet disposed adjacent an upper portion of the container to enable the water and dissolved detergent to be contacted by the downward water stream while rising to the outlet.

2. The apparatus according to claim 1 wherein the tipper wall forms a cover for the receptacle and is openable and closable relative to the receptacle.

3. The apparatus according to claim 2 wherein the water/detergent outlet is formed in the cover, the cover including an opening spaced horizontally from the water/detergent outlet and extending horizontally beyond the floor, to enable water and dissolved detergent exiting through the water/detergent outlet to flow along the cover and then downwardly through the opening.

4. The apparatus according to claim 3 wherein the opening constitutes a first opening, the receptacle including a second opening disposed beneath the first opening.

5. The apparatus according to claim 4 further including a housing in which the container is mounted, the water supply conduit mounted in the housing, the housing including an inclined lower surface so that water and dissolved detergent passing downwardly through the first and second openings travels on the inclined lower surface to exit a side of the housing.

6. The apparatus according to claim 1 wherein the jetting member has only a single water inlet and a single water outlet.

7. The apparatus according to claim 6 wherein the water inlet is wider than a water outlet of the water supply conduit.

8. The apparatus according to claim 1 wherein the jetting member includes a laterally outwardly projecting bearing member seated on an upper surface of the top wall for supporting the jetting member for rotation about the first axis.

9. The apparatus according to claim 1 wherein the jetting member includes an inner surface forming a passage from the water inlet to the water outlet, a plurality of blades disposed on the inner surface find arranged to be contacted by the water stream passing through the jetting member for rotating the jetting member about the vertical axis.

10. The apparatus according to claim 1 wherein an upper surface of the floor is of generally concave shape.

11. The apparatus according to claim 10 wherein the upper surface of the floor includes an upward projection at a center thereof.

* * * * *